US011021803B2

(12) United States Patent
Freydina et al.

(10) Patent No.: US 11,021,803 B2
(45) Date of Patent: Jun. 1, 2021

(54) ALUMINUM ALLOYS AND DEPOSITION METHODS

(71) Applicant: Xtalic Corporation, Marlborough, MA (US)

(72) Inventors: Evgeniya Freydina, Acton, MA (US); Joshua Garth Abbott, Rochester Hills, MI (US); Michelle Lee Houle, Boston, MA (US); Robert D. Hilty, Walpole, MA (US)

(73) Assignee: Xtalic Corporation, Marlborough, MA (US)

( * ) Notice: Subject to any disclaimer, the term of this patent is extended or adjusted under 35 U.S.C. 154(b) by 0 days.

(21) Appl. No.: 16/502,455

(22) Filed: Jul. 3, 2019

(65) Prior Publication Data

US 2020/0010969 A1 Jan. 9, 2020

Related U.S. Application Data

(60) Provisional application No. 62/694,165, filed on Jul. 5, 2018.

(51) Int. Cl.

| | |
|---|---|
| ***C25D 3/04*** | (2006.01) |
| ***C25D 3/54*** | (2006.01) |
| ***C25D 3/44*** | (2006.01) |
| ***C25D 3/66*** | (2006.01) |
| ***C25D 21/18*** | (2006.01) |
| ***C25D 3/56*** | (2006.01) |
| ***C22C 45/08*** | (2006.01) |

(52) U.S. Cl.

CPC ..... *C25D 3/04* (2013.01); *C22C 45/08* (2013.01); *C25D 3/44* (2013.01); *C25D 3/54* (2013.01); *C25D 3/56* (2013.01); *C25D 3/665* (2013.01); *C25D 21/18* (2013.01); *C22C 2200/02* (2013.01)

(58) Field of Classification Search

CPC ..... C25D 21/18; C25D 21/12; C25D 3/665
USPC ..... 205/234, 236, 237, 101
See application file for complete search history.

(56) References Cited

U.S. PATENT DOCUMENTS

2009/0194426 A1* 8/2009 Abbott ..... C25C 3/00 205/234

* cited by examiner

*Primary Examiner* — Brian W Cohen
(74) *Attorney, Agent, or Firm* — Wolf, Greenfield & Sacks, P.C.

(57) ABSTRACT

Electrodeposition bath compositions, additives, and maintenance methods are described. In one embodiment, an electrodeposition bath includes at least a first metal ionic species that reacts with a second metal ionic species to maintain either the first and/or second metal ionic species in a desired oxidation state for electrodeposition.

8 Claims, 3 Drawing Sheets

ALUMINUM ALLOYS AND DEPOSITION METHODS

RELATED APPLICATIONS

This application claims priority to U.S. Provisional Application No. 62/694,165, filed Jul. 5, 2018, which is incorporated herein by reference in its entirety.

FIELD

Disclosed embodiments are related to aluminum alloys and deposition methods.

BACKGROUND

Electrodeposition is a common technique for depositing coatings on a base material. Electrodeposition generally involves applying voltage or current between two electrodes in an electrodeposition bath to reduce metal ionic species dissolved in the bath, leading to deposition of metal or metal alloy coatings onto the cathode. The voltage or current may be applied between an anode and a cathode using a power supply. The cathode may serve as the base material to be coated. In some electrodeposition processes, the voltage or current may be applied as a complex waveform such as in pulse deposition, alternating current deposition, or reverse-pulse deposition. Electrodeposition bath chemistries, deposition parameters, and electrodeposition bath maintenance methods are typically used in combination with one another to provide alloys with desirable properties, such as alloys with desirable compositions, densities, mechanical properties, corrosion properties and/or surface smoothness.

SUMMARY

In one embodiment, an electrodeposition bath is provided. The electrodeposition bath may comprise a non-aqueous electrolyte, a first metal ionic species, and a second metal ionic species. The first metal ionic species may have a first reduced ionic state and a first oxidized ionic state. The second metal ionic species may have a second reduced ionic state and second oxidized ionic state. The first metal ionic species in the first oxidized ionic state may spontaneously react with the second metal ionic species in the second reduced ionic state to form the first metal ionic species in the first reduced ionic state and the second metal ionic species in the second oxidized ionic state.

In another embodiment, a method is provided. The method may comprise reacting a first metal ionic species in a first oxidized ionic state in a non-aqueous electrodeposition bath with a second metal ionic species in a second reduced ionic state in the non-aqueous electrodeposition bath to form the first metal ionic species in a first reduced ionic state and the second metal ionic species in a second oxidized ionic state in the electrodeposition bath. The method may also comprise electrodepositing at least one of the first metal ionic species in the first reduced ionic state and the second metal ionic species in the second oxidized ionic state onto a cathode at least partially immersed in the electrodeposition bath.

In another embodiment, an alloy is provided. The alloy may comprise a supersaturated solution of aluminum, chromium, and zirconium.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
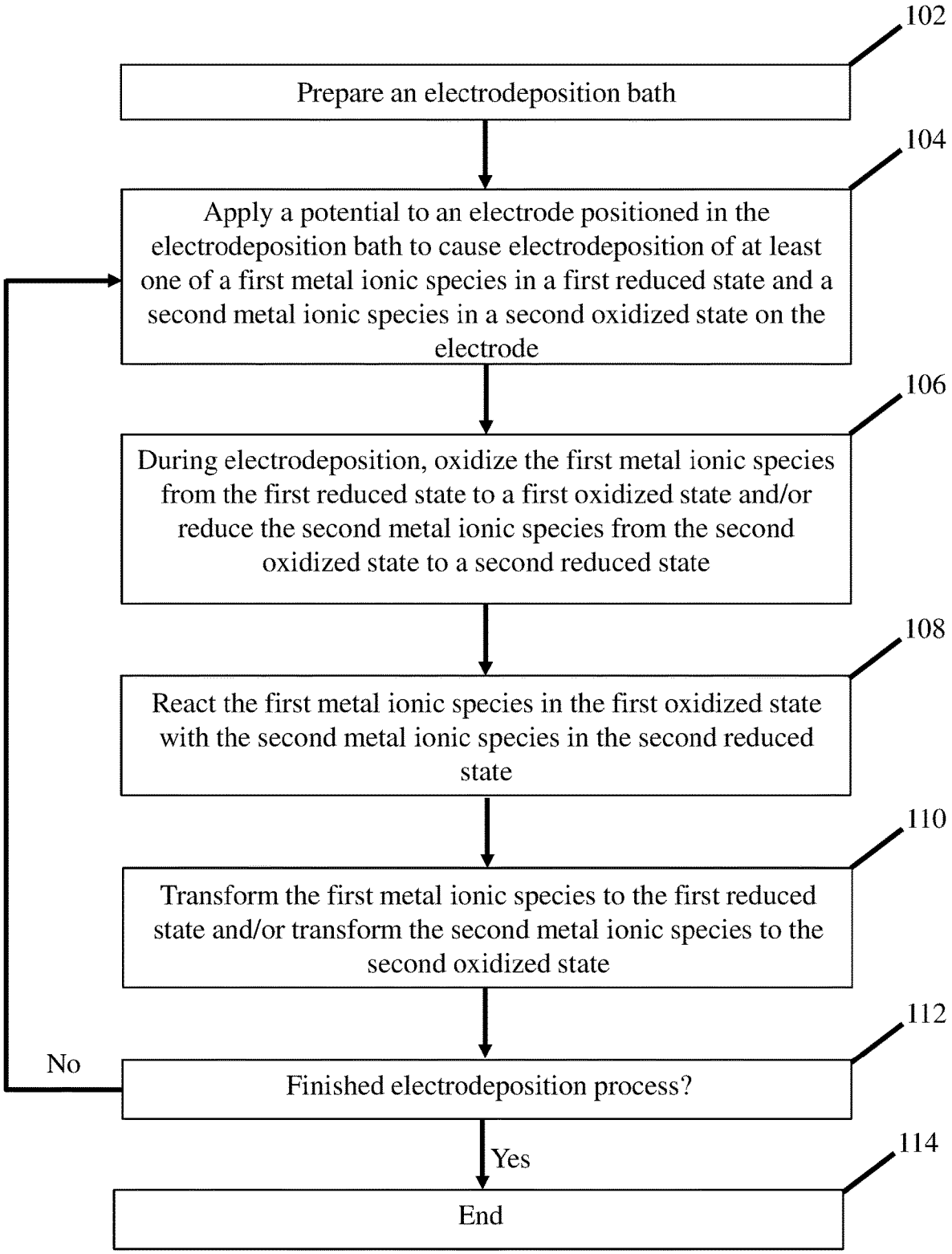
FIG. 1 is a flow diagram of an electrodeposition process including metal ionic species that react to maintain the metal ionic species in one or more desired oxidation states.

Electrodeposition of a material includes forming a solid material from one or more ionic species present in solution in an electrodeposition bath. In certain cases, it may be advantageous to form a solid material from a non-aqueous electrodeposition bath, such as an ionic liquid electrodeposition bath, an electrodeposition bath including one or more organic solvents, and/or an electrodeposition bath including one or more molten salts. Ionic species may be stable in these electrodeposition baths that are unstable in aqueous electrodeposition baths. However, in some instances it may be difficult, and in some instances impossible, to stabilize ionic species with appropriate oxidation states for electrodeposition in certain aqueous or non-aqueous electrodeposition baths. The inventors have recognized that it may be challenging to electrodeposit these species onto a desired substrate when they are not in appropriate oxidation states for electrodeposition in the electrodeposition bath. For example, it may be challenging to electrodeposit a species in an oxidation state with limited solubility in the electrodeposition bath. As another example, it may be challenging to electrodeposit a species that forms an oxidation state with limited diffusivity in the electrodeposition bath, such as a species that is in the form of an ionic polymer in the electrodeposition bath. In some cases, a species to be deposited from an electrodeposition bath may be capable of forming one ionic species that is appropriate for electrodeposition (e.g., when present in a first oxidation state) and another ionic species (e.g., when present in a second oxidation state) that is less suitable for, and in some cases incapable of, being used to electrodeposit a material. Further, in some instances, the ionic species that is appropriate for electrodeposition may spontaneously react to produce the ionic species that is inappropriate for electrodeposition in the electrodeposition bath. Therefore, in such an electrodeposition system, the electrodeposition bath may exhibit reduced plating efficiencies and/or need additional bath maintenance to maintain the ionic species within the electrodeposition bath in the desired oxidation states for electrodeposition.

In view of the above, the inventors have recognized the benefits associated with forming electrodeposition baths in which one or more species to be electrodeposited are automatically maintained in the electrodeposition bath in the desired oxidation states (i.e., oxidation states in which they form ionic species appropriate for electrodeposition). The inventors have recognized that electrodeposition baths with this property may be formulated by including two or more metal ionic species that can spontaneously undergo a reaction to transform at least one of the metal ionic species from an undesirable oxidation state to a desired oxidation state that is more readily deposited during an electrodeposition process. Therefore, electrodeposition baths with this combination of metal ionic species may be capable of automatically maintaining one or more of the metal ionic species present within the electrodeposition bath in a desired oxidation state for deposition during an electrodeposition process. The resulting alloys may also exhibit improved appearance and corrosion resistance with similar mechanical properties to similar alloys.

In one embodiment, a first metal ionic species A may have a first reduced ionic state $A^r$ and a first oxidized ionic state $A^o$. Similarly, a second metal ionic species B may have a second reduced ionic state $B^r$ and a second oxidized ionic state $B^o$. When the second metal ionic species is in the second reduced state, it may undergo a spontaneous reaction with the first metal ionic species in the first oxidized state as shown in the formula below. The spontaneous reaction may comprise a transfer of electrons from the second metal ionic species in the second reduced state to the first metal ionic species in the first oxidized state to form the second metal ionic species in the second oxidized state and the first metal species in the first reduced state. In some embodiments, one or both of the first oxidized ionic state and the second reduced state exhibit reduced capabilities of being electrodeposited as compared to their other oxidation states (e.g. reduced diffusivity, electrodeposition potentials that preclude deposition, and/or these oxidation states are insoluble in the bath). In contrast, one or both of the first reduced ionic state of the first metal ionic species and the second oxidized ionic state of the second metal ionic species may be desirable for electrodeposition.

$$A^o+B^r \rightarrow A^r+B^o$$

As described above, in certain embodiments, an electrodeposition bath may include combinations of first metal ionic species and second metal ionic species which may undergo spontaneous reactions with each other where the first metal ionic species is reduced and the second metal ionic species is oxidized. In some embodiments, reduction of the first metal ionic species and oxidation of the second metal ionic species may be spontaneous because the first metal ionic species in the first oxidized ionic state may have a more positive reduction potential than the second metal ionic species in the second oxidized ionic state. In other words, the reduction potential of the first metal ionic species from the first oxidized ionic state to the first reduced ionic state may be more positive than the oxidation potential of the second metal ionic species from the second reduced ionic state to the second oxidized ionic state.

Suitable metal ionic species may correspond to any metal ionic species that exhibit two or more stable oxidation states and are capable of being electrodeposited in at least one oxidation state and/or are capable of maintaining another metal ionic species in an oxidation state capable of being electrodeposited. Further, as described above, in some embodiments, these metal ionic species may include a first metal ionic species and a second metal ionic species that spontaneously undergo a redox reaction with each other. In certain embodiments, the first metal ionic species and/or the second metal ionic species may be a transition metal, a lanthanoid, and/or an actinoid. Appropriate transition metals include, but are not limited to, zirconium, chromium, tantalum, niobium, titanium, hafnium, molybdenum, tungsten, and vanadium. Additionally, appropriate lanthanoids and/or actinoids include, but are not limited to, uranium, plutonium, thorium, lanthanum, neodymium, praseodymium, and dysprosium. Other examples of suitable elements that may be used for the first metal ionic species and/or the second metal ionic species include iron, nickel, cobalt, copper, gallium, germanium, indium, lead, palladium, rhodium, ruthenium, tin, bismuth, and thallium. The above metal ionic species may also be combined within an electrodeposition bath with aluminum ions. For example, in one specific embodiment, an electrodeposition bath may include aluminum, the first metal ionic species may be chromium, and the second metal ionic species may be zirconium.

It should be understood that the various metal ionic species may be provided in any suitable amount relative to a total bath composition. Additionally, the various metal ionic species including, the first metal ionic species and the second metal ionic species, may be added to the electrodeposition bath in a variety of suitable manners. As an example, the first metal ionic species and/or the second metal ionic species may be added to the electrodeposition bath in the form of a salt, such as in the form of a halide (e.g., chloride) salt or any other salt that is compatible with the electrodeposition bath. As another example, the first metal ionic species and/or the second metal ionic species may be added to the electrodeposition bath in the form of a pure metal that may be electrochemically dissolved in the bath. Each of the first metal ionic species and the second metal ionic species may independently be added to the electrodeposition bath in a form such that it significantly dissolves in the electrodeposition bath (e.g., in the form of a soluble salt), or in a form such that it does not significantly dissolve in the electrodeposition bath (e.g., in the form of an insoluble salt). However, in some embodiments, at least one of the first metal ionic species and the second metal ionic species is added to the electrodeposition bath in an oxidation state that is either insoluble in the electrolyte and/or shows a reduced diffusivity within an electrolyte of the electrodeposition bath.

In some embodiments, it may be desirable to use a first metal ionic species to maintain the oxidation state of a separate second metal ionic species in an electrodeposition bath while limiting an amount of the first metal ionic species incorporated into a deposited material. Accordingly, and without wishing to be bound by any particular theory, it is believed that using a metal ionic species (e.g., a first metal ionic species or a second metal ionic species) in an oxidation state (e.g., the cation of an insoluble salt) that is both insoluble within the electrolyte of an electrodeposition bath and is capable of reacting with the another metal ionic species (e.g., a soluble metal ionic species) in the bath may result in a relatively constant minimal concentration of the metal ionic species dissolved in the bath. Specifically, reaction between the first metal ionic species in the insoluble oxidation state with a second metal ionic species may dissolve a portion of the first metal ionic species to help maintain the second metal ionic species in a desired oxidation state for electrodeposition purposes while maintaining a concentration of the first metal ionic species in the bath at a minimal concentration. Further, this concentration of the metal ionic species in the bath and deposited material may be maintained during an electrodeposition process.

In some embodiments, it may be desirable to limit an amount of a particular oxidation state of a metal ionic species dissolved in an electrolyte of an electrodeposition bath to either modify the properties and/or composition of a deposited material. Accordingly, an electrodeposition bath may include a first metal ionic species and a second metal ionic species in amounts such that the extent of the reaction between the first metal ionic species and the second metal ionic species is limited by either the first metal ionic species or the second metal ionic species. For example, the electrodeposition bath may comprise an excess of the first metal ionic species in the first oxidized ionic state in comparison to the second metal ionic species in the second reduced state. In this case, the second metal ionic species in the second reduced state may fully transform into the second metal ionic species in the second oxidized ionic state while the first metal ionic species in the first oxidized ionic state only partially transforms into the first metal species in the first reduced state. It should be understood that the reverse may also be possible. That is, the electrodeposition bath may comprise an excess of the second metal ionic species in the second reduced state in comparison to the first metal species in the first oxidized ionic state and that the first metal ionic species in the first oxidized ionic state may fully transform into the first metal ionic species in the first reduced state while the second metal species in the second reduced state only partially transforms into the second metal species in the second oxidized ionic state.

In some embodiments, the first metal ionic species and the second metal ionic species may both remain in an electrodeposition bath after reacting with each other therein. For example, the first metal ionic species and the second metal ionic species may both remain dissolved in the electrodeposition bath after reacting with each other. In such an embodiment, the two metal ionic species may be co-deposited with one another and/or another metal ionic species such as aluminum. Alternatively, in another embodiment, one or the other of the metal ionic species may have a lower diffusivity, or other parameter, such that it does not readily co-deposit with the other metal ionic species in the material. Further, in yet another embodiment, a reaction between the first metal ionic species and the second metal ionic species may result in removal of one of the first metal ionic species and the second metal ionic species from the electrodeposition bath. For instance, one of the first metal ionic species and the second metal ionic species may precipitate out of solution to form a solid within the bath.

In some embodiments, an electrodeposition bath may comprise a second metal ionic species that is zirconium. The second oxidized ionic state may be $Zr^{4+}$ that is desired for electrodeposition and the second reduced ionic state may be $Zr^{2+}$ which shows reduced electrodeposition capabilities. For example, and without wishing to be bound by theory, $Zr^{2+}$ may form polymeric chains which electrodeposit at unfavorably slow rates due to reduced diffusivities within an electrodeposition bath as compared to $Zr^{4+}$. However, in certain baths, $Zr^{4+}$ may undesirably and spontaneously react with aluminum also present in an electrodeposition bath (e.g., freshly deposited aluminum, aluminum in an electrode, etc.) to form $Zr^{2+}$. Accordingly, it may be desirable to include species that can spontaneously react with the $Zr^{2+}$ to form $Zr^{4+}$ in electrodeposition baths designed to deposit zirconium.

In some embodiments, an electrodeposition bath may comprise a first metal ionic species that is chromium. The first oxidized ionic state that is less suitable for electrodeposition may be $Cr^{3+}$ and the first reduced ionic state suitable for electrodeposition may be $Cr^{2+}$. Specifically, $Cr^{3+}$ may precipitate as $CrCl_3$ from an electrodeposition bath in which the $Cr^{2+}$ ion is more soluble. However, in certain baths, $Cr^{2+}$ may undesirably and spontaneously react with moisture, and/or other oxidants present in an electrodeposition bath, to form $Cr^{3+}$. Accordingly, it may be desirable to include species that can spontaneously react with the $Cr^{3+}$ to form $Cr^{2+}$ in electrodeposition baths designed to deposit chromium.

In view of the above, in some embodiments, chromium may be the first metal ionic species and zirconium may be the second ionic species. In certain electrodeposition baths, a spontaneous reaction may occur between $Cr^{3+}$ and $Zr^{2+}$ that produces $Cr^{2+}$ and $Zr^{4+}$. That is, a spontaneous reaction occurs that transforms first metal ionic species chromium from undesirable first oxidized state $Cr^{3+}$ to desirable first reduced state $Cr^{2+}$ and transforms second metal ionic species zirconium from undesirable second reduced state $Zr^{2+}$ to desirable second oxidized state $Zr^{4+}$.

In some embodiments, an electrodeposition bath may comprise dissolved aluminum in a relatively high amount. In some embodiments, the concentration of dissolved aluminum in the electrodeposition bath may be greater than or equal to 60 g/kg, greater than or equal to 80 g/kg, greater than or equal to 100 g/kg, or greater than or equal to 120 g/kg. Correspondingly, the concentration of dissolved aluminum may be less than or equal to 130 g/kg, less than or equal to 120 g/kg, less than or equal to 100 g/kg, or less than or equal to 80 g/kg. Combination of the above ranges are contemplated include, for example, 60 g/kg to 130 g/kg. However, ranges both greater and less than those noted above are also contemplated as the disclosure is not so limited.

In some embodiments, the concentration of chromium in any form (e.g., dissolved, precipitated as a solid) in the electrodeposition bath may be greater than or equal to 0.1 g/kg, greater than or equal to 0.2 g/kg, greater than or equal to 0.5 g/kg, greater than or equal to 1 g/kg, greater than or equal to 2 g/kg, or greater than or equal to 8 g/kg. In some embodiments, the concentration of chromium in any form in the electrodeposition bath may be less than or equal to 10 g/kg, less than or equal to 8 g/kg, less than or equal to 2 g/kg, less than or equal to 1 g/kg, less than or equal to 0.5 g/kg, or less than or equal to 0.2 g/kg. Combinations of the above-referenced ranges are also possible (e.g., greater than or equal to 0.1 g/kg and less than or equal to 10 g/kg). Other ranges are also possible.

In some embodiments, the concentration of dissolved chromium in the electrodeposition bath may be greater than or equal to 0.1 g/kg, greater than or equal to 0.2 g/kg, greater than or equal to 0.5 g/kg, greater than or equal to 1 g/kg, greater than or equal to 2 g/kg, or greater than or equal to 8 g/kg. In some embodiments, the concentration of dissolved chromium in the electrodeposition bath may be less than or equal to 10 g/kg, less than or equal to 8 g/kg, less than or equal to 2 g/kg, less than or equal to 1 g/kg, less than or equal to 0.5 g/kg, or less than or equal to 0.2 g/kg. Combinations of the above-referenced ranges are also possible (e.g., greater than or equal to 0.1 g/kg and less than or equal to 10 g/kg). Other ranges are also possible.

In some embodiments, the concentration of zirconium in any form (e.g., $Zr^{2+}$, $Zr^{4+}$) in the electrodeposition bath may be greater than or equal to 0.1 g/kg, greater than or equal to 0.2 g/kg, greater than or equal to 0.5 g/kg, greater than or equal to 1 g/kg, greater than or equal to 2 g/kg, greater than or equal to 5 g/kg, greater than or equal to 10 g/kg, greater than or equal to 20 g/kg, or greater than or equal to 25 g/kg. In some embodiments, the concentration of zirconium in any form in the electrodeposition bath may be less than or equal to 30 g/kg, less than or equal to 25 g/kg, less than or equal to 20 g/kg, less than or equal to 10 g/kg, less than or equal to 5 g/kg, less than or equal to 2 g/kg, less than or equal to 1 g/kg, less than or equal to 0.5 g/kg, or less than or equal to 0.2 g/kg. Combinations of the above-referenced ranges are also possible (e.g., greater than or equal to 0.1 g/kg and less than or equal to 30 g/kg). Other ranges are also possible.

When present, the first metal ionic species and the second metal ionic species may have a variety of suitable reduction potentials with respect to the potential of an aluminum electrode. In some embodiments, the first metal ionic species and/or the second metal ionic species may have a reduction potential that is similar to that of aluminum to facilitate codeposition with aluminum. For example, a reduction potential of the first metal ionic species from the first oxidized ionic state to the first reduced ionic state and/or of the second metal ionic species from the second oxidized ionic state to the second reduced ionic state may be greater than or equal to the reduction potential of aluminum, greater than or equal to 0.1 V greater than or equal to the reduction potential of aluminum, greater than or equal to 0.3 V greater than the reduction potential of aluminum, greater than or equal to 0.5 V greater than the reduction potential of aluminum, or greater than or equal to 0.7 V greater than the reduction potential of aluminum. Correspondingly, in some embodiments, the reduction potential of the first metal ionic species from the first oxidized ionic state to the first reduced ionic state and/or of the second metal ionic species from the second oxidized ionic state to the second reduced ionic state may be less than or equal to 1 V greater than the reduction potential of aluminum, less than or equal to 0.7 V greater than the reduction potential of aluminum, less than or equal to 0.5 V greater than the reduction potential of aluminum, or less than or equal to 0.3 V greater than the reduction potential of aluminum. Combinations of the above-referenced ranges are also possible (e.g., the reduction potential of aluminum and less than or equal to 1 V greater than the reduction potential of aluminum, or greater than or equal to the reduction potential of aluminum and less than or equal to 0.7 V greater than the reduction potential of aluminum). Other ranges are also possible. The reduction potentials may be measured by cyclic voltammetry for example As described above, certain embodiments relate to electrodeposition baths and/or to methods involving electrodeposition baths. In certain embodiments, the electrodeposition bath may include a nonaqueous electrolyte as well as one or more appropriate co-solvents. Depending on the embodiment, the nonaqueous electrolyte includes at least one of an ionic liquid or molten salt with one or more metal ionic species dissolved therein corresponding to the metallic elements for use in a depositing a desired material. Appropriate ionic liquids and co-solvents are described in more detail below.

Those of ordinary skill in the art will be aware of suitable ionic liquids to use in connection with the electrodeposition baths and methods described herein. The term "ionic liquid" as used herein is given its ordinary meaning in the art and refers to a salt in the liquid state at ambient temperature. In embodiments wherein an electrodeposition bath comprises an ionic liquid, this is sometimes referred to as an ionic liquid electrolyte. The ionic liquid electrolyte may optionally comprise other liquid components, for example, a co-solvent, as described herein. An ionic liquid generally comprises at least one cation and at least one anion. In some embodiments, the ionic liquid comprises an imidazolium, pyridinium, pyridazinium, pyrazinium, oxazolium, triazolium, pyrazolium, pyrrolidinium, piperidinium, tetraalkylammonium or tetraalkylphosphonium salt. In some embodiments, the cation is an imidazolium, a pyridinium, a pyridazinium, a pyrazinium, a oxazolium, a triazolium, or a pyrazolium. In some embodiments, the ionic liquid comprises an imidazolium cation. In some embodiments, the anion is a halide. In some embodiments, the ionic liquid comprises a halide anion and/or a tetrahaloaluminate anion. In some embodiments, the ionic liquid comprises a chloride anion and/or a tetrachloroaluminate anion. In some embodiments, the ionic liquid comprises tetrachloroaluminate or bis(trifluoromethylsulfonyl)imide. In some embodiments, the ionic liquid comprises butylpyridinium, 1-ethyl-3-methylimidazolium [EMIM], 1-butyl-3-methylimidazolium [BMIM], benzyltrimethylammonium, 1-butyl-1-methylpyrrolidinium, 1-ethyl-3-methylimidazolium, or trihexyltetradecylphosphonium. In some embodiments, the ionic liquid comprises 1-ethyl-3-methylimidazolium chloride. In one specific embodiment, a chloroaluminate ionic liquid such as [EMIM]Cl/$AlCl_3$ and/or [BMIM]Cl/$AlCl_3$ may be used in the electrodeposition bath. [EMIM]Cl/$AlCl_3$ electrodeposition baths may have ratios of $AlCl_3$ to [EMIM]Cl of between 1.1 and 2 in certain embodiments.

In some embodiments, a co-solvent used in an electrodeposition bath is an organic solvent which may, or may not be, an aromatic solvent. In some embodiments, the co-solvent is selected from the group consisting of toluene, benzene, tetralin (or substituted versions thereof), ortho-xylene, meta-xylene, para-xylene, mesitylene, halogenated benzenes including chlorobenzene and dichlorobenzene, para-chlorotoluene, and methylene chloride. In some embodiments, the co-solvent is toluene. The co-solvent may be present in any suitable amount. In some embodiments, the co-solvent is present in an amount between about 1 vol % and 99 vol %, between about 10 vol % and about 90 vol %, between about 20 vol % and about 80 vol %, between about 30 vol % and about 70 vol %, between about 40 vol % and about 60 vol %, between about 45 vol % and about 55 vol %, or about 50 vol % versus the total bath composition. In some embodiments, the co-solvent is present in an amount greater than about 50 vol %, 55 vol %, 60 vol %, 65 vol %, 70 vol %, 80 vol %, or 90 vol % versus the total bath composition. In some embodiments, the co-solvent and the ionic liquid form a homogenous solution.

The specific co-solvent to be used may be selected based upon any number of desired characteristics including, for example, viscosity, conductivity, vapor pressure, boiling point, and other characteristics as would be apparent to one of ordinary skill in the art.

One or more co-solvents may be mixed with the ionic liquid in any desired ratio to provide the desired electrodeposition bath properties. For example, in some embodiments, the co-solvent may also be selected based on its boiling point. In some cases, a higher boiling point co-solvent may be employed as it can reduce the amount and/or rate of evaporation from the electrolyte, and thus, may aid in stabilizing the process. Those of ordinary skill in the art will be aware of the boiling points of the co-solvents described herein (e.g,. toluene, 111° C.; methylene chloride, 41° C.;

1,2-dichlorobenzene, 181° C.; o-xylene, 144° C.; and mesitylene, 165° C.). While specific co-solvents and their boiling points are listed above, other co-solvents are also possible. Furthermore, in some embodiments the co-solvent is selected based upon multiple criteria including, but not limited to, conductivity, boiling point, and viscosity of the resulting electrodeposition bath.

In some embodiments, an electrodeposition bath may be a freshly prepared electrodeposition bath. In other embodiments, the electrodeposition bath may be aged as the disclosure is not so limited.

The above noted methods and electrodeposition bath compositions may be used to electrodeposit an alloy that may be challenging to form using other methods. For instance, in some embodiments, the currently disclosed electrodeposition baths and methods may be used to electrodeposit an alloy that comprises a supersaturated solid solution of two or more components, such as a supersaturated solid solution of three components. As used herein, a supersaturated solid solution is a single phase comprising at least two components, one of which is present in excess of its equilibrium concentration in the phase. It may be advantageous for an alloy to comprise a supersaturated solid solution in comparison to a material formed using more traditional methods, such as powder sintering, that may form the corresponding two or more equilibrium phases. Depending on the particular embodiment, the supersaturated solid solution may exhibit one or more desirable properties as compared to the equilibrium material including multiple phases, including, but not limited to a desirable crystal structure and/or one or more desirable engineering properties. For example, the supersaturated solid solution may have high levels of hardness, high levels of resistance to pit formation, low tensile stress, improved ductility, and/or improved visual appearance of the alloy. One non-limiting example of a suitable supersaturated solid solution is an aluminum alloy including a supersaturated concentration of chromium and/or zirconium. Other supersaturated solid solutions are also contemplated.

In some embodiments, an alloy may be an aluminum alloy, or may be an alloy that comprises aluminum. The alloy may comprise aluminum in a variety of suitable amounts. In some embodiments, the atomic percentage of aluminum in the alloy may be greater than or equal to 30%, greater than or equal to 50%, greater than or equal to 80%, greater than or equal to 82%, greater than or equal to 85%, greater than or equal to 88%, greater than or equal to 90%, greater than or equal to 93%, or greater than or equal to 95%. In some embodiments, the atomic percentage of aluminum in the alloy may be less than or equal to 97%, less than or equal to 95%, less than or equal to 93%, less than or equal to 90%, less than or equal to 88%, less than or equal to 85%, less than or equal to 82%, less than or equal to 80%, or less than or equal to 50%. Combinations of the above-referenced ranges are also possible (e.g., greater than or equal to 30% and less than or equal to 97%, or greater than or equal to 85% and less than or equal to 88%). Other ranges both greater than and less than those noted above are also possible. The atomic percentage of aluminum in the alloy may be determined using any appropriate measurement technique including X-ray diffraction or energy dispersive spectroscopy, for example.

In some embodiments, an alloy may comprise chromium. The atomic percentage of chromium in the alloy may be greater than or equal to 0.01%, greater than or equal to 0.02%, greater than or equal to 0.05%, greater than or equal to 0.1%, greater than or equal to 0.2%, greater than or equal to 0.5%, greater than or equal to 1%, greater than or equal to 2%, greater than or equal to 3%, greater than or equal to 5%, greater than or equal to 8%, greater than or equal to 10%, greater than or equal to 12%, greater than or equal to 15%, greater than or equal to 20%, or greater than or equal to 50%. The atomic percentage of chromium in the alloy may also be less than or equal to 70%, less than or equal to 50%, less than or equal to 20%, less than or equal to 15%, less than or equal to 12%, less than or equal to 10%, less than or equal to 8%, less than or equal to 5%, less than or equal to 3%, less than or equal to 2%, less than or equal to 1%, less than or equal to 0.5%, less than or equal to 0.2%, less than or equal to 0.1%, or less than or equal to 0.02%. Combinations of the above-referenced ranges are also possible (e.g., greater than or equal to 0.01% and less than or equal to 70%, greater than or equal to 3% and less than or equal to 15%, or greater than or equal to 3% and less than or equal to 8%). Other ranges both greater than and less than those noted above are also possible. The atomic percentage of chromium in the alloy may be determined using any appropriate measurement technique including X-ray fluorescence for example.

In some embodiments, an alloy may comprise zirconium. The atomic percentage of zirconium in the alloy may be greater than or equal to 3%, greater than or equal to 5%, greater than or equal to 8%, greater than or equal to 10%, greater than or equal to 12%, or greater than or equal to 17%. The atomic percentage of zirconium in the alloy may be less than or equal to 20%, less than or equal to 17%, less than or equal to 15%, less than or equal to 12%, less than or equal to 10%, less than or equal to 8%, or less than or equal to 5%. Combinations of the above-referenced ranges are also possible (e.g., greater than or equal to 3% and less than or equal to 20%, or greater than or equal to 3% and less than or equal to 15%). Other ranges both greater than and less than those noted above are also possible. The atomic percentage of zirconium in the alloy may be determined using any appropriate measurement technique including X-ray fluorescence for example.

In some embodiments, an alloy may comprise both chromium and zirconium. The combined atomic percentage of chromium and zirconium in the alloy may be greater than or equal to 3%, greater than or equal to 5%, greater than or equal to 8%, greater than or equal to 10%, or greater than or equal to 12%. The combined atomic percentage of chromium and zirconium in the alloy may be less than or equal to 15%, less than or equal to 12%, less than or equal to 10%, less than or equal to 8%, or less than or equal to 5%. Combinations of the above-referenced ranges are also possible (e.g., greater than or equal to 3% and less than or equal to 15%). Other ranges are also possible. The combined atomic percentage of chromium and zirconium in the alloy may be determined using any appropriate measurement technique including X-ray diffraction for example.

It should be understood that the above noted atomic percentages of aluminum, chromium, and/or zirconium may be combined with one another in any appropriate manner to provide a range of alloys as the disclosure is not limited to any particular combination of the noted elements.

In some embodiments, alloys described herein may have a nanocrystalline grain structure. As used herein, a "nanocrystalline" structure refers to a structure in which the number-average size of crystalline grains is less than 1 μm. The number-average size of the crystalline grains provides equal statistical weight to each grain and is calculated as the sum of all spherical equivalent grain diameters divided by the total number of grains in a representative volume of the body. Therefore, in some embodiments, a nanocrystalline microstructure has an average grain size that is less than or equal to about 0.5 μm, 0.1 μm, 0.05 μm, 0.02 μm, and/or 0.01 μm. Separately, in some embodiments an alloy may exhibit an amorphous structure. As known in the art, an amorphous structure is a non-crystalline structure characterized by having no long range symmetry in the atomic positions. Examples of amorphous structures include glass, or glass-like structures. Therefore, an amorphous microstructure may exhibit no apparent average grain size due to the lack of individual grains and crystal structure. The average grain size of an alloy may be determined using X-ray diffraction.

While alloys with nanocrystalline and/or amorphous structures are discussed above, it should be understood that electrodeposited metals having microstructures with average grain sizes that are larger than the nanometer scale are also contemplated. For example, an electrodeposited metal may have an average grain size that is between or equal to about 1 μm and 10 μm, 1 μm and 50 μm, 10 μm and 100 μm, or any other desirable size scale as the disclosure is not so limited.

Turning now to the figures, several non-limiting embodiments of electrodeposition bath chemistries and systems as well as their methods of use for depositing materials are discussed in more detail. However, it should be understood that the various features and concepts may either be used individually or in any appropriate combination as the disclosure is not so limited.

FIG. 1 depicts a generalized flow diagram for one embodiment of a method for maintaining the chemistry of an electrodeposition bath. An initial electrodeposition bath is prepared at 102. At 104 a potential is applied to an electrode, such as a cathode, at least partially immersed or positioned in the electrodeposition bath, to cause electrodeposition of at least one of a first metal ionic species in a first reduced state and a second metal ionic species in a second oxidized ionic state onto the electrode. In some embodiments, both the first metal ionic species in the first reduced ionic state and the second metal ionic species in the second oxidized ionic state may be deposited onto the electrode. When both the first metal ionic species in the first reduced ionic state and the second metal ionic species in the second oxidized ionic state are deposited onto an electrode, they may be deposited in substantially similar concentrations or in substantially different concentrations as the disclosure is not so limited. In some embodiments, one of the first metal ionic species and the second metal ionic species may be deposited in trace amounts while the other of the first metal ionic species and the second metal ionic species is deposited in non-trace amounts. In some embodiments, one or more further ionic species may be deposited during step 104, such as a third metal ionic species (e.g., aluminum).

As shown in step 106 of FIG. 1, in some embodiments, the first metal ionic species is transformed from the first reduced state to a first oxidized ionic state that is less capable of being electrodeposited and/or the second metal ionic species is transformed from the second oxidized state to a second reduced ionic state that is less capable of being electrodeposited. Subsequently, at 108, the first metal ionic species in the first oxidized ionic state reacts with the second metal ionic species in the second reduced state within the electrodeposition bath. In step 110, this reaction results in the transformation of the first metal species to the first reduced state and/or the second metal ionic species is transformed into the second oxidized ionic state. It should be understood that 104-110 occur continuously during an electrodeposition process and occur concurrently with one another. Additionally, it should be noted that steps 106-110 regarding the transformation of the metal ionic species between different oxidation states may occur spontaneously during the electrodeposition process, without requiring input from any individual or instrument performing the method. Further, while the electrodeposition process may be ended at steps 112 and 114, the reaction of the first and second metal ionic species to maintain the metal ionic species in one or more desired oxidation states may also occur when the electrodeposition bath is not being actively used to electrodeposit a material.

Figure 2A:
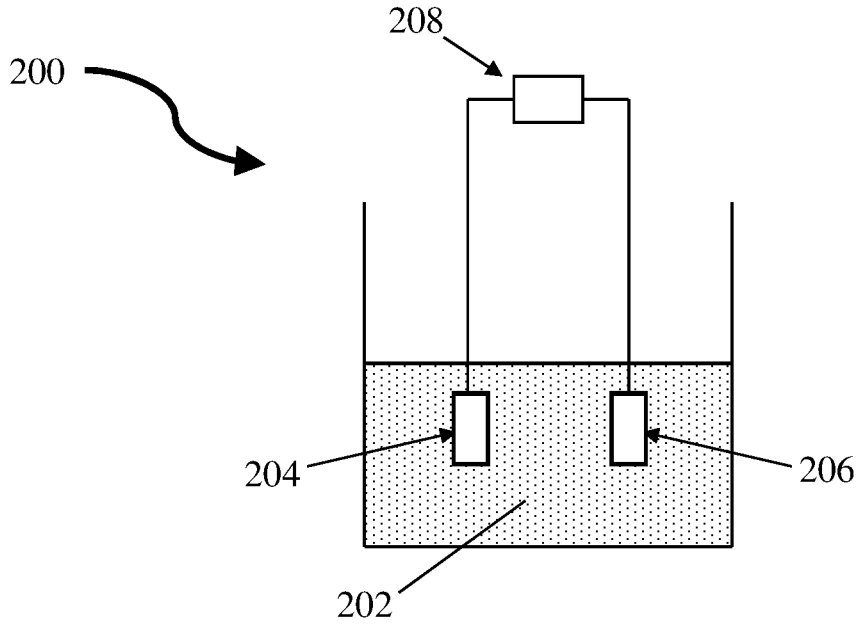
FIG. 2A is a schematic representation of one embodiment of an electrodeposition system.
Figure 2B:
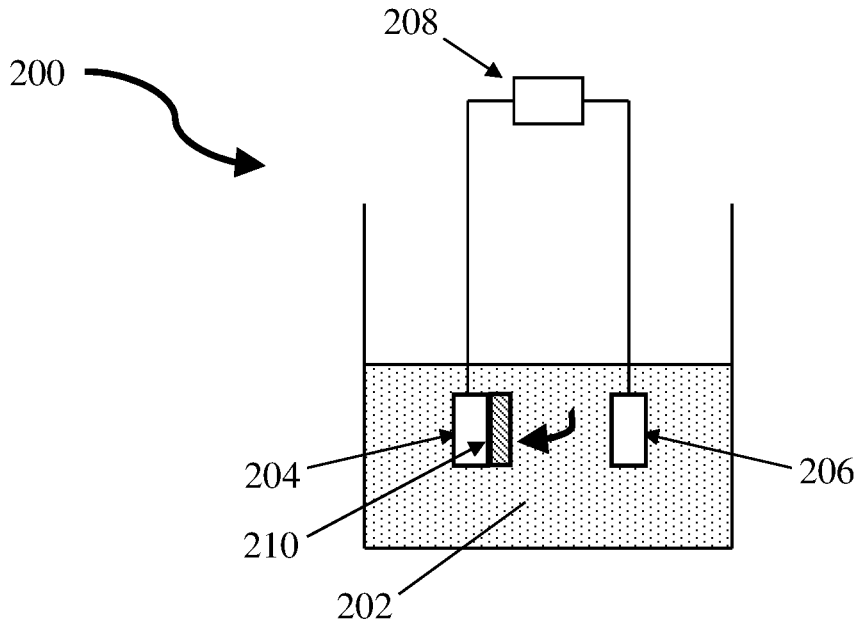
FIG. 2B is a schematic representation of the electrodeposition system of FIG. 2 with an alloy plated onto the anode.

FIGS. 2A and 2B show one non-limiting example of an electrodeposition system 200 in accordance with certain embodiments described herein. The depicted electrodeposition system includes a electrodeposition bath 202. A cathode 204 and anode 206 are provided in the bath. The bath may include metal sources either in the form of metal ionic species (e.g., a first metal ionic species, a second metal ionic species, aluminum, or other appropriate metal ionic species) dissolved in the bath. The metal ionic species may either be added directly to the bath and/or the anode itself may be used as a source for the metal ionic species present in the bath for electrodepositing a metal layer on the cathode. The bath may also include one or more additives and/or co-solvents as described herein. A power supply 208 is connected to the anode and the cathode. During use, the power supply generates a waveform which creates a voltage difference between the anode and cathode. The voltage difference leads to reduction of metal ionic species in the bath which deposit in the form of a coating on the cathode, in this embodiment, which may also function as the deposition substrate in some embodiments. Deposition onto the cathode is shown in FIG. 2B, where coating 210 is deposited onto cathode 204. It should be understood that the illustrated system is not intended to be limiting and may include a variety of modifications as known to those of skill in the art.

Figure 3:
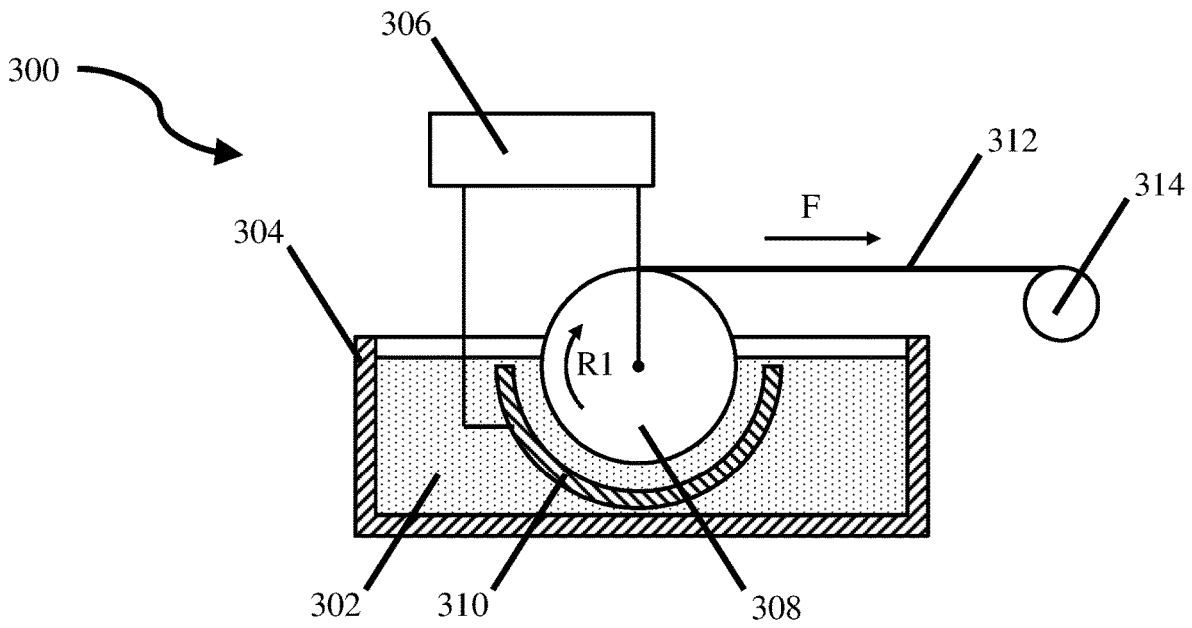
FIG. 3 is a schematic representation of one embodiment of an electrodeposition system.

FIG. 3 depicts one embodiment of an electrodeposition system 300 for forming a metal coating in a continuous manner. System 300 in FIG. 3 includes an electrodeposition bath 302 contained within a container 304. A power source 306 is connected to an electrodeposition surface 308 and a counter electrode 310 that are both at least partially immersed within the electrodeposition bath. In the depicted embodiment, the electrodeposition surface corresponds to a rotating surface such as a rotating mandrel or barrel that is at least partially submerged in the electrodeposition bath and rotated in direction R1. As the electrodeposition surface is rotated, an electrodeposition potential is applied by the power source to both the electrodeposition surface and the counter electrode. This results in metal ionic species contained within the electrodeposition bath (e.g., first metal ionic species, second metal ionic species, aluminum, and/or other appropriate metal ionic species) depositing onto the electrodeposition surface. As the electrodeposition surface rotates, a metal is continuously deposited on the electrodeposition surface until it is delaminated to form a freestanding metallic foil 312. The freestanding metallic foil is continuously transferred as it is delaminated from the electrodeposition surface in direction F where it is wound onto a spool 314.

While several electrodeposition systems have been described above, it should be understood that the methods, electrodeposition baths, and chemistries disclosed herein may be used with any appropriate type of electrodeposition system as the disclosure is not so limited.

In addition to the above, it is also noted that a power source used to electrodeposit a material in combination with the methods, electrodeposition baths, and chemistries disclosed herein may be driven in any number of ways. For example, depending on the embodiment, a power source may be used to an electrodeposition waveform including direct deposition, forward pulses, reverse pulses, rests, combinations of the above, or any other appropriate electrodeposition process. Further, transitions between the different portions of a waveform may either be done using step functions, or gradual transitions may be provided between the different portions of the waveform as the current disclosure is not limited in this fashion. In some embodiments, the electrodeposition waveform includes forward and/or reverse pulses with a preselected current density. For example, the current densities of the forward and reverse pulses may either be the same, the forward pulse may have a greater current density than the reverse pulse, or the reverse pulses may have a greater current density then the forward pulse.

Figure 4:
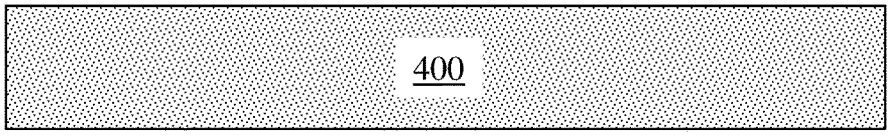
FIG. 4 is a schematic representation of one embodiment of a supersaturated electrodeposited alloy.

FIG. 4 shows one non-limiting embodiment of an alloy made in accordance with certain embodiments of the methods and electrodeposition baths described herein. In the depicted embodiment, an alloy 400 is formed using a method such as that described in relation to FIG. 1. Further, due to the method of deposition, the material is deposited in a uniform fashion in a single phase as depicted in the figure. In some embodiments, this single phase may be a single phase that is supersaturated with at least one component as described previously.

EXAMPLE

Aluminum Alloys including Chromium and Zirconium

The following example describes the formation of alloys comprising aluminum, chromium, and zirconium.

Experiment 1: A ternary Al—Zr—Cr alloy was plated from a 1.75:1 ($AlCl_3$:EMIMCl) ionic liquid comprising 0.8 g/kg of Zr (from $ZrCl_4$) and 0.2 g/kg of Cr (from $CrCl_2$). 0.2 g of insoluble $CrCl_3$ was also added to the bath. The bath age was ~50Ah/L. Electrodeposition was conducted at 50° C. using a forward pulse waveform in a cell with a pure Al anode and 1 inch Al alloy disc cathode. The cathode was rotated at 200 rpm during electrodeposition, which was carried out for 0.5 hrs at an average plating rate of 40 microns/hr.

Experiment 2: A ternary Al—Zr—Cr alloy was plated from a 1.75:1 ($AlCl_3$:EMIMCl) ionic liquid comprising 0.6 g/kg of Zr (from $ZrCl_4$) and 0.6 g/kg of Cr (from $CrCl_2$). 0.2 g of insoluble $CrCl_3$ powder was also added to the bath. The bath age was ~50 Ah/L. Plating was conducted at 50° C. using a forward pulse waveform in a cell with a pure Al anode and 1 inch Al alloy disc cathode. The cathode was rotated at 200 rpm and electrodeposition, which was carried out for 0.5 hrs at an average plating rate of 40 microns/hr.

Experiment 3: A ternary Al—Zr—Cr alloy was plated from a 1.75:1 ($AlCl_3$:EMIMCl) ionic liquid comprising 1.0g/kg of Zr (from $ZrCl_4$) and 0.6g/kg of Cr (from $CrCl_2$). 0.2 g of insoluble $CrCl_3$ was also added to the bath. The bath age was ~50 Ah/L. Plating was conducted at 50° C. using a forward pulse waveform in a cell with a pure Al anode and 1 inch Al alloy disc cathode. The cathode was rotated at 200 rpm and electrodeposition was carried out for 0.5 hrs at an average plating rate of 40 microns/hr using a forward pulse waveform.

Table 1, below, displays several properties of the alloys formed from Experiments 1-3.

TABLE 1

| Experiment No. | Atomic % Cr | Atomic % Zr | Hardness | Pitting potential |
|---|---|---|---|---|
| 1 | 0.5 | 5.6 | 200 | −0.37 |
| 2 | 4.4 | 3.1 | 290 | −0.26 |
| 3 | 4.5 | 7.4 | 300 | −0.17 |

The alloys formed in Experiments 1-3 had desirable values of hardness and pitting potential.

EXAMPLE

Niobium Oxidation States 0.5-1 wt % $NbCl_5$ was deposited in various ionic liquids (including 2:1 $AlCl_3$:EMIMCl, 1-ethyl-3-methylimidazolium triflate [EMIM][OTf], and 1-buty-1-methyl-pyrrolidinium bistrifluorosulfonylimide [BMPy][TFSI]) at 50-60° C. Cyclic voltammetry experiments were carried out using a platinum rotating disc electrode rotating at 300rpm with a scan rate of 10-50 mV/sec. The cyclic voltammetry scans confirmed that niobium exhibits multiple stable oxidation states within these electrolytes indicating it may be possible to use niobium with the disclosed methods and electrodeposition bath chemistries.

In addition to the above, tantalum is known to behave very similarly to niobium. Accordingly, tantalum is also expected to exhibit multiple stable oxidation states in these electrodeposition bath chemistries and capable of being used with the disclosed methods and systems.

EXAMPLE

Aluminum Alloy with Large Zirconium Concentration

An Al—Zr alloy was plated from a 1.75:1 ($AlCl_3$:EMIMCl) ionic liquid comprising 1.9 g/kg of Zr (from $ZrCl_4$). The bath also included 50 vol % toluene, which served as a cosolvent. The bath age was ~44 Ah/L. Prior to electrodeposition, the bath had been periodically treated with alumina powder to maintain the Zr ions in the +4 oxidation state. Plating was conducted at 50° C. using a forward and reverse pulse waveform in a cell with a pure Al anode and 25 $cm^2$ Al cathode. The electrolyte was agitated by a shaped stir rod while electrodeposition was carried out for 3.5 hrs at an average plating rate of ~11 microns/hr. The resulting aluminum alloy deposit contained 14-17 atomic % Zr.

EXAMPLE

Aluminum Alloy with Large Chromium Concentration

An Al—Cr alloy was plated was plated from a 2:1 ($AlCl_3$:EMIMCl) ionic liquid containing 3.5 g/kg of Cr (from $CrCl_2$). This bath also included 1.5 vol % ethylaluminum dichloride ($EtAlCl_2$, from 25 wt % $EtAlCl_2$ in toluene), which served as a moisture scavenger to help prevent $Cr^{2+}$ from being converted into $Cr^{3+}$. Plating was conducted at 60° C. using a forward and reverse pulse waveform in a cell with a pure Al anode and 1 inch high strength steel disc cathode. The cathode was rotated at 100 rpm and electrodeposition was carried out for 2 hrs at an average plating rate of 10 microns/hr. The resulting aluminum alloy deposit contained 40-50 atomic % Cr.

EXAMPLE

Aluminum-Tantalum Alloy

The following example describes the formation of an aluminum-tantalum alloy.

A binary Al—Ta alloy was plated from a 1.5:1 ($AlCl_3$:EMIMCl) ionic liquid comprising 3 g/kg of Ta (from $TaCl_5$). Plating was conducted at 60° C. using a forward and reverse pulse waveform in a cell with a pure Al anode and 0.5 cm Cu alloy disc cathode. The cathode was rotated at 300 rpm and electrodeposition was carried out for 0.5 hrs at an average plating rate of 40 microns/hr. Tantalum made up 3-5 atomic % of the resultant alloy.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A method comprising:

reacting a first metal ionic species in a first oxidized ionic state in a non-aqueous electrodeposition bath with a second metal ionic species in a second reduced ionic state in the non-aqueous electrodeposition bath to form the first metal ionic species in a first reduced ionic state and the second metal ionic species in a second oxidized ionic state in the electrodeposition bath;

electrodepositing at least one of the first metal ionic species in the first reduced ionic state and the second metal ionic species in the second oxidized ionic state onto a cathode at least partially immersed in the electrodeposition bath.

2. The method of claim 1, wherein a reduction potential of the first metal ionic species from the first oxidized ionic state to the first reduced ionic state is more positive than an oxidation potential of the second metal ionic species from the second reduced ionic state to the second oxidized ionic state.

3. The method of claim 1, further comprising depositing both the first metal ionic species in the first reduced ionic state and the second metal ionic species in the second oxidized ionic state onto the cathode.

4. The method of claim 1, further comprising depositing aluminum ions in the electrodeposition bath onto the cathode.

5. The method of claim 4, wherein the first metal ionic species is chromium.

6. The method of claim 5, wherein the second metal ionic species is zirconium.

7. The method of claim 1, wherein at least one of the first metal ionic species in the first oxidized ionic state and the second metal ionic species in the second reduced ionic state are insoluble in the electrolyte.

8. The method of claim 1, further comprising limiting the reaction of the first metal ionic species in the first oxidized ionic state with the second metal ionic species in the second reduced ionic state by limiting a concentration of the first metal ionic species or the second metal ionic species.

* * * * *